United States Patent [19]

Barriac

[11] Patent Number: 4,721,221

[45] Date of Patent: Jan. 26, 1988

[54] MOLDED PLASTIC CLOSURE WITH SEALING LINER

[75] Inventor: Jacques J. Barriac, Toledo, Ohio

[73] Assignee: Owens-Illinois Closure Inc., Toledo, Ohio

[21] Appl. No.: 4,452

[22] Filed: Jan. 20, 1987

[51] Int. Cl.[4] ..... B65D 53/04

[52] U.S. Cl. ..... 215/350

[58] Field of Search ..... 215/341, 343, 350, 351, 215/352

[56] References Cited

U.S. PATENT DOCUMENTS

| | | | |
|---|---|---|---|
| 4,076,152 | 2/1978 | Mumford | 215/350 X |
| 4,527,705 | 7/1985 | Prades | 215/341 X |
| 4,585,135 | 4/1986 | Sinnott | 215/343 X |
| 4,629,083 | 12/1986 | Druitt | 215/350 X |

FOREIGN PATENT DOCUMENTS

| | | | |
|---|---|---|---|
| 2123393 | 2/1984 | United Kingdom | 215/341 |

*Primary Examiner*—Donald F. Norton
*Attorney, Agent, or Firm*—H. G. Bruss

[57] ABSTRACT

A molded plastic closure for a beverage container, the closure having a shell with a top panel and a depending skirt, the shell being molded in one piece from a hard thermoplastic material. The closure is provided with an annular flange which extends from the underside of the top panel and which forms an annular space with the inside of the skirt. A liner is formed in situ within the closure by compression molding from a compression moldable soft, rubbery thermoplastic material, the underside of the top panel and the inside of the annular flange serving as molding surfaces. The annular flange is supported against lateral loads by a series of ribs which extend between the annular flange and the depending skirt. The liner is interlocked with the annular flange by interengaging ribs and recesses. Both a top seal only closure for non-pressurized beverages and a top and side seal closure for pressurized beverages are disclosed.

46 Claims, 4 Drawing Figures

MOLDED PLASTIC CLOSURE WITH SEALING LINER

BACKGROUND OF THE INVENTION

1. Field Of The Invention

This invention relates to a molded plastic closure which includes a sealing liner to permit the closure to be applied in a sealing manner to a liquid containing glass or plastic bottle. More particularly, this invention relates to a compression molded plastic closure with a sealing liner that may be formed in the closure during the compression molding process. The closure is shown both in an embodiment which is suitable for use in applications where the associated container must be sealed both on the top and on the side, for example, in the packaging of carbonated beverages, and in an embodiment where the associated container need be sealed only on the top thereof.

2. Description Of The Prior Art

Lined, compression molded thermoplastic closures are known in the prior art, and have been extensively used in the packaging of carbonated soft drinks, where each such closure must seal the associated container on the top and around an annular portion of the side of the finish of such container. U.S. Pat. No. 4,378,893 (S. L. Wilde, et al.) discloses a type of top and side seal compression molded lined plastic closure which, in a nominal diameter of 28 millimeters, has been utilized successfully in the packaging of carbonated soft drinks. U.S. Pat. No. 4,407,422 (S. L. Wilde, et al.) discloses a similar compression molded lined plastic closure for a bottle. U.S. Pat. Nos. 4,381,840 (E. M. Ostrowsky) and 4,462,502 (W. R. Luenser) illustrate other types of lined, molded plastic closures for bottles.

Each of the aforesaid prior art patents discloses a molded plastic closure that utilizes a sealing liner which extends beyond the sealing surface of the container that the closure is to be affixed to. In such a closure, the periphery of the liner engages and is supported by the inside of the sidewall of the closure or by structure of the closure which is closely adjacent thereto and which is rigidly connected thereto. This construction requires excess material in the liner of the closure and, in the case of a liner which is compression molded within the body of the closure, for example, a compression molded liner of the type disclosed in the aforesaid U.S. Pat. No. 4,378,893, the size of the liner complicates the compression molding process and tooling.

SUMMARY OF THE INVENTION

According to the present invention there is provided a molded plastic closure that includes a soft, organic sealing liner to permit the closure to be sealingly applied to a glass or plastic container for use in the packaging of a liquid, such as a carbonated or a non-carbonated beverage product. The closure, which can be manufactured either in a top seal only embodiment for application to a container for the packaging of a non-carbonated product, or in a top and side seal embodiment for application to a container for the packaging of a carbonated product, has a single piece outer shell component which is manufactured from a suitable thermoplastic material, for example, polypropylene or high density polyethylene, by injection molding or by compression molding, and a sealing liner which lies against the underside of a top panel portion of the closure shell, and which, preferably, is molded in situ within the closure shell by compression molding from a suitable compression moldable organic material. Since the inside diameter of the closure shell is somewhat greater than the outside diameter of the rim of the container to which the closure is applied, the outside diameter of the sealing liner of the closure need not be as great as the inside diameter of the closure shell. To reduce the required diameter of the sealing liner, which is especially useful in producing the liner by in situ compression molding of the liner within the closure to simplify such compression molding process and equipment, the underside of the top panel portion of the closure shell is provided with a downwardly depending annular flange whose inside diameter is only slightly greater than the outside diameter of the container rim, or the portion thereof which sealingly engages the closure liner. Thus, the flange which depends downwardly from the underside of the top panel of the closure shell forms a dam against which the closure liner can be molded by compression molding, and which, thereby, facilitates the withdrawal of the compression molding tooling from the closure. The use of such a dam also permits control over the size of the closure liner to correspond to that required for proper sealing engagement with the rim of the container, to thereby substantially reduce the amount of material needed in the manufacture of the liner, and this is advantageous even when the liner is in the form of a separate disc which is inserted into the closure shell. Further, the dam can be molded with suitable radially extending recesses therein, and this permits the compression molding of the liner against the grooved surface of the dam with a configuration that forms a secure tongue and groove or dovetail locking arrangement with the dam of the closure. Further, since the compression molding of the closure liner takes place at a temperature where many organic or thermoplastic materials have good adhesive properties, by a careful selection of materials for the closure itself and for the closure liner, the closure liner will bond itself to the material of the closure during the compression molding of the liner, to ensure permanent retention of the closure liner within the closure.

Accordingly, it is an object of the present invention to provide an improved lined, molded plastic closure. More particularly, it is an object of the present invention to provide an improved lined, molded plastic closure which is suitable for use in the packaging of beverage products in glass or plastic containers. Specifically, it is an object of the present invention to provide a lined molded plastic closure in which the outside of the closure liner is restrained against a flange that is positioned within the closure radially inwardly of the inside of the closure skirt to define an annular space therebetween. For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
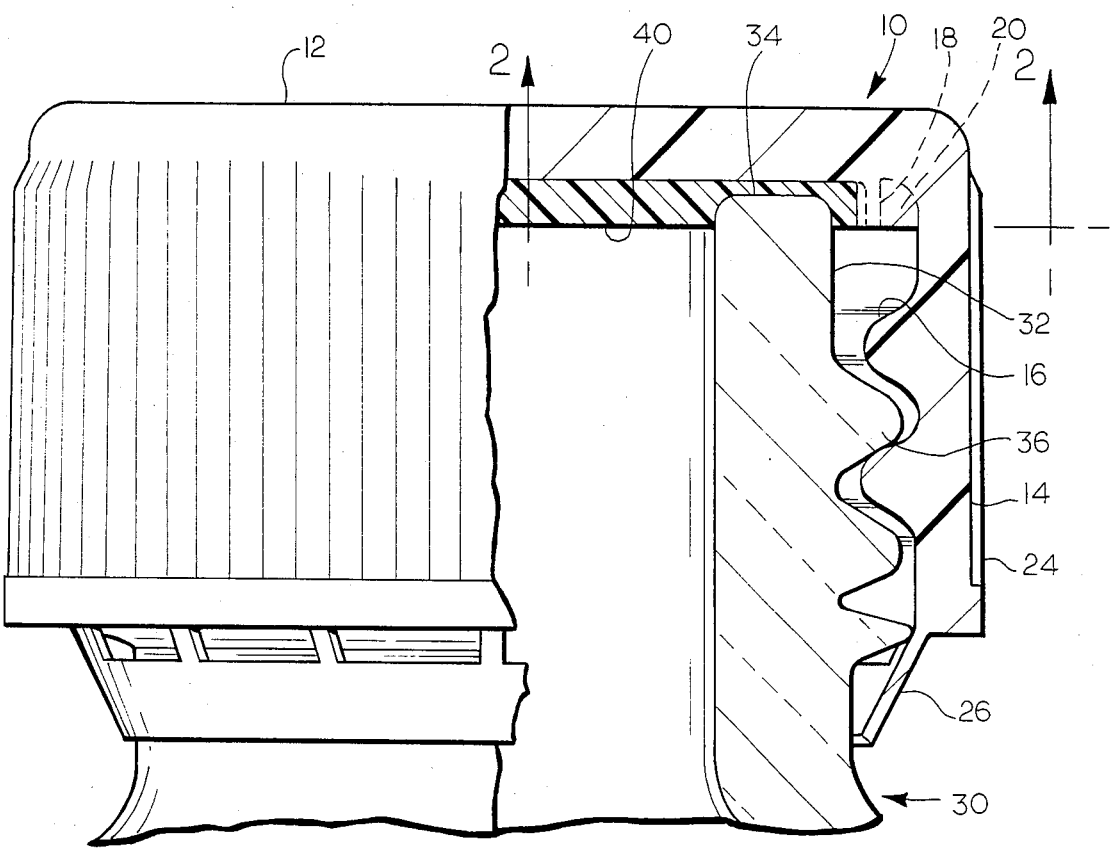
FIG. 1 is an elevational view, partly in section, of a preferred embodiment of a lined molded plastic closure according to the present invention as applied to the finish of a container.

As is shown in FIG. 1, a closure according to the present invention is indicated generally by the reference numeral 10 and is shown in the closing position on a container which is shown fragmentarily and which is indicated generally by reference numeral 30. The container 30 is of a type which is suitable for the packaging of a still or non-pressurized beverage therein, such as a fruit juice or a fruit-flavored beverage, and the container 30 is provided with a neck or finish portion 32 which terminates in a rim 34 and which is provided with an outwardly projecting and helically extending thread 36 for a purpose which will be hereinafter explained more fully. Containers such as the container 30 are typically made either of glass or of a suitable thermoplastic material, such as polyethylene terephthalate (PET), and most of such containers are manufactured with a 28 millimeter finish diameter, that is, with a "T" dimension, the diameter at the outside of the container thread 36, of 28 millimeters.

The closure 10 is comprised of a top panel portion 12 which is generally horizontally disposed, in the orientation of the closure that is shown in FIG. 1, and which spans the mouth of the container 30, and a vertically depending annular skirt portion 14 which extends downwardly from the top panel portion 12. The annular skirt portion 14 of the closure 10 is provided with an inwardly projecting and helically extending thread 16 which is engageable with the thread 36 of the container 30 to permit the closure 10 to be applied to the container 30 by a screwing on action and to be removed from the container 30 by an unscrewing action.

Figure 3:
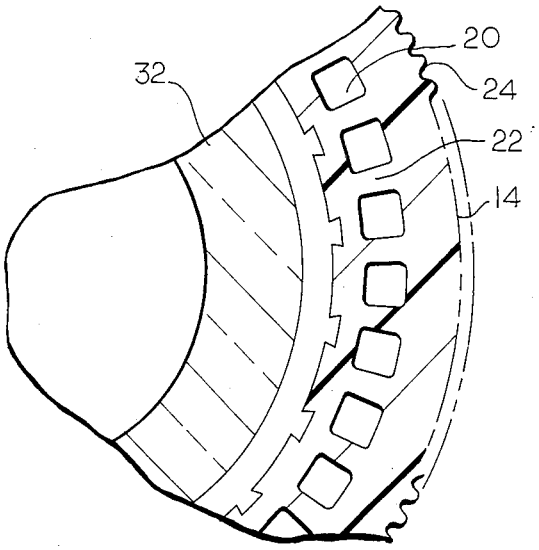
FIG. 3 is a view similar to FIG. 2 showing an alternative embodiment of the closure according to the embodiment of FIG. 1.
Figure 2:
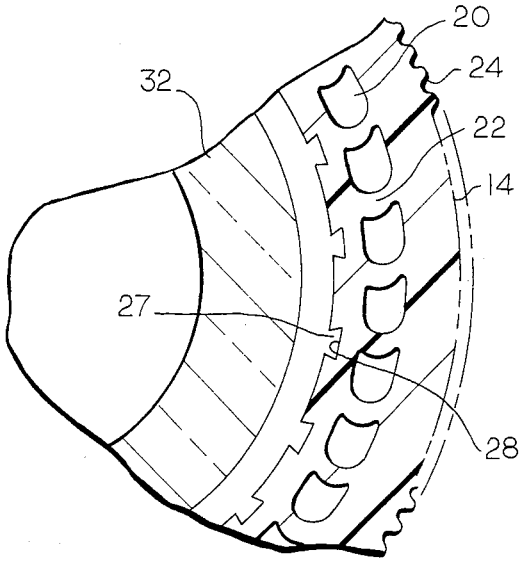
FIG. 2 is a sectional view taken on line 2—2 of FIG. 1.

The underside of the top panel portion 12 of the closure 10 is provided with a flange 18 which extends downwardly therefrom and which is spaced radially inwardly from the inside of the annular skirt portion 14 to define an annular space 20 therewith. The annular flange 18 serves to retain the peripheral portion of a sealing liner 40 which is positioned against the underside of the top panel portion 12 of the closure 10, and which is trapped between the rim 34 of the container 30 and the underside of the top panel portion 12 of the closure 10 when the closure 10 is tightly affixed to the container 30, as is shown in FIG. 1, to form a liquid tight seal between the closure 10 and the container 30. If desired to laterally reinforce the flange 18 of the closure 10 to maintain the desired sealing pressure between the sealing liner 40 and the rim 34 of the finish 32 of the container 30, the annular space 20 may be provided with a circumferential series of spaced apart, generally radially extending ribs 22. As is shown in FIG. 2, the ribs 22 are provided with a degree of curvature, in a plane that extends transversely through the longitudinal central axis of the container 30, to facilitate the flexure of such ribs 32 under radially applied loads. Alternatively, as is shown in FIG. 3, the annular space 20 can be provided with ribs 22' which do not have any appreciable degree of curvature thereto and which extend radially with respect to the longitudinal central axis of the container. Optionally, the closure 10 may be provided with a series of vertically extending ribs 24 on the outside of the annular skirt portion 14 to facilitate the gripping of the closure 10 during application and removal, and the closure 10 may be provided with a tamper indicating band 26 at the bottom of the annular skirt portion 14, similar to the arrangement shown in FIG. 6 of U.S. Pat. No. 4,378,893 (Wilde, et al.), which is described therein as a "pilfer-band". The purpose of the tamper-indicating band 26 is to fracture from the annular skirt portion 14 upon the first removal or attempted removal of the closure 10 from the container 30, and to thereby provide a consumer or the retailer or one of its employees with a visually detectable indication of the prior opening or attempted opening of the container 30.

The closure 10, not including the sealing liner 40, is, preferably, molded in an integral or single piece from a hard, dimensionally stable thermoplastic material, such as high density polyethylene or polypropylene, and the molding may be accomplished either by injection molding or, in the case of a product which is produced in very large quantities, by compression molding. The liner 40 is formed from a soft, rubbery thermoplastic material, such as an ethylene vinyl acetate copolymer (EVA), or a styrene/rubber/polypropylene copolymer, or blends that include one or another of such copolymers. While it is contemplated that the liner 40 may be fabricated from sheets of such material by punching out discs of such material or by separately molding such liners, preferably, in accordance with the preferred embodiment of the present invention, the liner 40 is molded in situ within the closure 10 by a compression molding process, such compression molding process utilizing the underside of the top panel portion 12 of the closure 10 and the inside of the flange 18 of the closure 10 as molding surfaces. Where the liner 40 is formed by compression molding, as described, it is, preferably, interlocked with the flange 18 by providing the periphery of the liner 40 with a circumferentially spaced apart series of radially projecting ribs 27 and by providing the inside of the flange 18 with a circumferentially spaced apart series of radially extending recesses 28, each such recess 28 receiving one of such ribs 28 to help maintain the sealing liner 40 in position against the underside of the top panel portion 12 of the closure 10 and the inside of the flange 18, especially against the forces which tend to rotate the liner 40 with respect to the closure 10 during the application of the closure 10 to the container 30 and during the removal of the closure 10 from the container 30. Preferably, as shown, the ribs 27 and the recesses 28 are configured so as to form a dovetail fit between each such rib 27 and the recess 28 which receives such rib 27. Such dovetail configuration of the ribs 27 and recesses 28 will further help to prevent the sealing liner 40 from disengaging from the closure 10, especially under the influence of the vibrations and impact loads which the closure 10 can experience during the bulk shipment of such closure and like closures from the closure manufacturing plant to the beverage packaging plant.

If the sealing liner 40 is formed by compression molding, as heretofore described, it will, inherently, be brought to a sufficiently high temperature to develop adhesive properties with respect to the material of the closure 10, if compatible materials are selected for the molding of the closure 10 and the compression molding of the sealing liner 40, respectively. In that regard, it has been found that ethylene vinyl acetate copolymer and styrene-rubber-polypropylene copolymer will bond to polypropylene if compression molded thereagainst. Of course, should the sealing liner 40 be formed by compression molding from a material which will, inherently, bond to the material of the closure 10, the arrangement of the interengaging ribs 27 of the sealing liner 40 and the recesses 28 of the flange 18 of the closure 10 may prove to be unnecessary.

Figure 4:
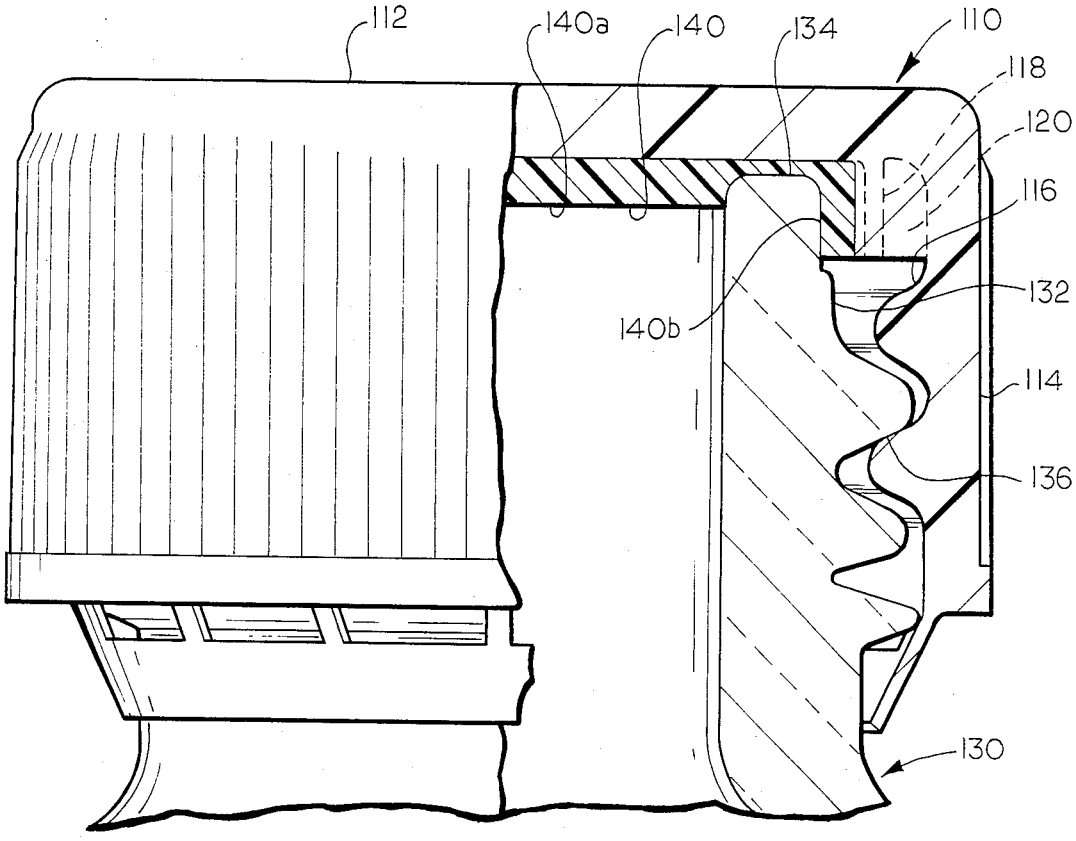
FIG. 4 is a view similar to FIG. 1 of an alternative embodiment of the closure according to the present invention.

FIG. 4 illustrates an embodiment of the invention in which a closure 110 is shown in the closing position on a container 130 which is shown fragmentarily. The container 130 is of a type which is suitable for the packaging of a pressurized beverage therein, for example, beer or a carbonated soft drink, and is provided with a neck or finish portion 132 that terminates in a rim 134. The finish 132 of the container is provided with an outwardly projecting and helically extending thread 136. The container 130 may either be made of glass or a thermoplastic material that is suitable for the packaging of a pressurized beverage therein, for example, PET, and, typically, is manufactured with a finish diameter of 28 millimeters.

The closure 110 has a top panel portion 112 and a vertically depending annular skirt portion 114 which is formed integrally with the top panel portion 112 and which extends downwardly therefrom to surround the upper portion of the finish portion 132 of the container. The annular skirt portion 114 of the closure 110 has an inwardly projecting and helically extending thread 116 which is engageable with the thread 136 of the container to permit the closure 110 to be applied to the container 110 by a screwing on action and to be removed from the container 130 by an unscrewing action.

The underside of the top panel portion 112 of the closure 110 is provided with an annular flange 118 which extends downwardly therefrom and which is spaced radially inwardly from the inside of the annular skirt portion 114 to define an annular space 120 therewith. For purposes which will be more fully explained hereinafter, the flange has sufficient extent from the top panel portion 112 to extend past the rim 134 of the container, when the closure 110 is tightly affixed to the container, and to surround the upper portion of the finish portion 132 of the container 130. The annular flange 118 serves to retain the peripheral portion of a sealing liner 140 which is positioned against the underside of the top panel portion 112 of the closure 110. The sealing liner 140 has an inner disc like portion **140*a* which is trapped between the rim 134 of the container and the underside of the top panel portion 112 of the closure to form a seal against the rim 134 when the closure 110 is tightly affixed to the container 130. Further, the sealing liner 140 has an outer annular portion 140*b* which is formed integrally with the inner portion 140*a* and which has greater extent in a direction parallel to the central axis of the container 130 than the inner disc like portion 140*a* to extend past the rim 134 of the container 130 and to surround the upper portion of the finish portion 132 of the container 130. The outer portion 140*b* of the sealing liner 140, thus, is trapped between the upper portion of the finish portion 132 of the container 130 and the annular flange and serves to form a second seal between the sealing liner 140 of the closure 110 and the container 130 against the side of the finish portion of the container 130. Thus, the closure 110** is a "top and side seal" closure, which is the closure type that is used in the packaging of pressurized beverages to ensure good pressure retention within the package.

The closure 110, not including the sealing liner 140, like the closure 10 of the embodiment of FIGS. 1 through 3 is, preferably, formed in a single piece from a hard, dimensionally stable thermoplastic material by injection molding or compression molding and the liner 140, like the liner 40 of the embodiment of FIGS. 1 through 3, is formed from a soft, rubbery thermoplastic material, preferably by compression molding it in situ within the closure 110. While not shown in the drawing, the liner 140 and the flange 118 may be provided with interlocking ribs and recesses, like the flange 18 and the liner 40 of the closure 10 of the embodiment of FIGS. 1 through 3, to help prevent relative rotation between the closure 110 and the liner 140. Further, the closure 110, like the closure 10 of the embodiment of FIGS. 1 through 3, is provided with a tamper-indicating band 126 corresponding in design and function to the tamper-indicating band 26 of the closure 10 of FIGS. 1 through 3.

Although the best mode contemplated by the inventor for carrying out the present invention as of the filing date hereof has been shown and described herein, it will be apparent to those skilled in the art that suitable modifications, variations, and equilvalents may be made without departing from the scope of the invention, such scope being limited solely by the terms of the following claims.

What is claimed is:

1. A closure for sealingly engaging the finish portion of a container, the finish portion of the container terminating in a rim and including closure engaging means, said closure comprising, in combination:

a top portion adapted to span the finish of the container;

an annular skirt extending downwardly from said top portion and being adapted to surround an upper portion of the finish portion of the container, including the rim, said skirt including engaging means for securely engaging the finish portion of the container;

an annular member extending downwardly from said top portion, said annular member being separated from said annular skirt and forming an annular space therebetween;

a plurality of spaced apart ribs positioned in an annular array in said annular space, each of said ribs extending between said annular skirt and said annular member;

sealing liner means positioned inside of said annular member and against said finish portion of said container, said sealing liner means being adapted to be compressed between said top portion of said closure and at least the rim of the finish portion of the container, whereby said closure may sealingly engage the finish portion of the container when said closure is securely engaged to the finish portion of the container, said ribs being adapted to reinforce said annular member against deformation when said closure sealingly engage the finish portion of the container.

2. A closure according to claim 1 wherein the finish portion of the container has a longitudinal central axis and wherein each of said ribs is curved in a plane that extends transversely through the longitudinal central axis of the container when said closure sealingly engages the finish portion of the container.

3. A closure according to claim 1 wherein said top portion, said annular skirt and said annular member are formed integrally with one another in one piece from a thermoplastic material.

4. A closure according to claim 3 wherein said one piece is formed by a process the is selected from the group consisting of injection molding and compression molding.

5. A closure according to claim 4 wherein said thermoplastic material has a major ingredient which is selected from the group consisting of high density polyethylene and polypropylene.

6. A closure according to claim 3 wherein one of said annular member and said sealing liner means comprises radially extending recess means, wherein the other of said annular member and said sealing liner comprises radially extending rib means, and wherein said radially extending rib means is received in said radially extending recess means to help to prevent relative rotation between said annular member and said sealing liner means.

7. A closure according to claim 6 wherein said recess means comprises a plurality of circumferentially spaced apart, radially extending recesses, wherein said radially extending rib means comprises a plurality of circumferentially spaced apart, radially extending ribs, each of said plurality of circumferentially spaced apart radially extending recesses receiving one of said plurality of circumferentially spaced apart radially extending ribs.

8. A closure according to claim 7 wherein said sealing liner means is formed in situ within said closure against said top portion and said annular member from a compression moldable thermoplastic material by compression molding.

9. A closure according to claim 8 wherein said compression moldable thermoplastic material is heat sealable to said thermoplastic material, and wherein said sealing liner means is formed in situ within said closure by compression molding at a temperature that is sufficiently high to form a heat seal bond between said compression moldable thermoplastic material and said thermoplastic material.

10. A closure according to claim 9 wherein said thermoplastic material includes polypropylene as its major ingredient and wherein said compression moldable thermoplastic material has as its major ingredient a material selected from the group consisting of ethylene vinyl acetate copolymer, and styrene/rubber/polypropylene copolymer.

11. A closure according to claim 3 wherein said engaging means for engaging the finish portion of the container is a helical thread.

12. A closure according to claim 7 wherein said sealing liner means is imperforate in configuration.

13. A package comprising, in combination:

a container having a finish finish portion, said finish portion including closure engaging means and terminating in a rim, and a closure sealingly engaging said finish portion of said container, said closure comprising;

a top portion spanning said finish of said container;

an annular skirt extending downwardly from said top portion and surrounding an upper portion of said finish portion of said container, including said rim, said annular skirt including engaging means securely engaging said closure engaging means of said finish portion of said container;

an annular member extending downwardly from said top portion of said closure, said annular member being separated from said annular skirt and forming an annular space therebetween;

a plurality of spaced apart ribs positioned in an annular array in said annular space, each of said rib extending between said annular skirt and said annular member; and sealing liner means positioned inside of said annular member, at least a portion of said sealing liner means lying against said finish portion of said container, said at least a portion of said sealing liner means being compressed between said top portion of said closure and at least said rim of said finish portion of said container to form a seal between said closure and said finish portion of said closure, said ribs reinforcing said annular member against deformation.

14. A package according to claim 13 wherein said finish of said container has a longitudinal central axis and wherein each of said ribs of said closure is curved in a plane that extends transversely through said longitudinal central axis of said container when said closure sealingly engages said finish portion of said container.

15. A package according to claim 13 wherein said top portion, said annular skirt and said annular member of said closure are formed integrally with one another in one piece from a thermoplastic material.

16. A package according to claim 15 wherein said one piece is formed by a process that is selected from the group consisting of injection molding and compression molding.

17. A package according to claim 16 wherein said thermoplastic material has a major ingredient which is selected from the group consisting of high density polyethylene and polypropylene.

18. A package according to claim 15 wherein one of said annular member and said sealing liner means of said closure comprises radially extending recess means, wherein the other of said annular member and said sealing liner means of said closure comprises radially extending rib means, and wherein said radially extending rib means is received in said radially extending recess means to help to prevent relative rotation between said annular member and said sealing liner means of said closure.

19. A package according to claim 18 wherein said recess means comprises a plurality of circumferentially spaced apart, radially extending recesses, wherein said radially extending rib means comprises a plurality of circumferentially spaced apart radially extending ribs, each of said plurality of circumferentially spaced apart radially extending recesses receiving one of said plurality of circumferentially spaced apart radially extending ribs.

20. A package according to claim 19 wherein said sealing means is formed in situ within said closure against said top portion and against said annular member from a compression moldable thermoplastic material by compression molding.

21. A package according to claim 20 wherein said compression moldable thermoplastic material is heat sealable to said thermoplastic material, and wherein said sealing liner means of said closure is formed in situ within said closure by compression molding at a temperature that is sufficiently high to form a heat seal bond between said compression moldable thermoplastic material and said thermoplastic material.

22. A package according to claim 21 wherein said thermoplastic material includes polypropylene as its major ingredient and wherein said compression moldable thermoplastic material has as its major ingredient a material selected from the group consisting of ethylene vinyl acetate copolymer, and styrene/rubber/polypropylene copolymer.

23. A package according to claim 15 wherein said closure engaging means of said container comprises a helical thread and wherein said engaging means of said closure comprises a helical thread.

24. A package according to claim 13 wherein said sealing liner means comprises a portion lying against said annular member in sealing engagement with at least a portion of said finish portion of said container, said annular member of said closure extending downwardly from said top of said closure sufficiently far to engage said portion of said sealing liner means and to maintain said portion of said sealing liner means firmly against said at least a portion of said finish portion of said container.

25. A package according to claim 20 wherein said sealing liner means of said closure is imperforate in configuration.

26. A closure for sealingly engaging the finish portion of a container, the finish portion of the container terminating in a rim and including closure engaging means, said closure comprising, in combination:

a top portion adapted to span the finish of the container;

an annular skirt extending downwardly from said top portion and being adapted to surround an upper portion of the finish portion of the container, including the rim, said skirt including engaging means for securely engaging the finish portion of the container;

an annular member extending downwardly from said top portion, said annular member being separated from said annular skirt and forming a space therebetween; and sealing liner means positioned inside of said annular member and against said finish portion of said container, said sealing liner means being adapted to be compressed between said top portion of said closure and at least the rim of the finish portion of the container, whereby said closure may sealingly engage the finish portion of the container when said closure is securely engaged to the finish portion of the container, said sealing liner means being formed in situ within said closure against said top portion and said annular member from a compression moldable thermoplastic material by compression molding.

27. A closure according to claim 26 wherein said sealing liner means is imperforate in configuration.

28. A closure according to claim 26 wherein said top portion, said annular skirt and said annular member are formed integrally with one another in one piece from a thermoplastic material.

29. A closure according to claim 28 wherein said one piece is formed by a process that is selected from the group consisting of injection molding and compression molding.

30. A closure according to claim 29 wherein said thermoplastic material has a major ingredient which is selected from the group consisting of high density polyethylene and polypropylene.

31. A closure according to claim 28 wherein one of said annular member and said sealing liner means comprises radially extending recess means, wherein the other of said annular member and said sealing liner comprises radially extending rib means, and wherein said radially extending rib means is received in said radially extending recess means to help to prevent relative rotation between said annular member and said sealing liner means.

32. A closure according to claim 31 wherein said recess means comprises a plurality of circumferentially spaced apart, radially extending recesses, wherein said radially extending rib means comprises a plurality of circumferentially spaced apart, radially extending ribs, each of said plurality of circumferentially spaced apart radially extending recesses receiving one of said plurality of circumferentially spaced apart radially extending ribs.

33. A closure according to claim 26 wherein said compression moldable thermoplastic material is heat sealable to said thermoplastic material, and wherein said sealing liner means is formed in situ within said closure by compression molding at a temperature that is sufficiently high to form a heat seal bond between said compression moldable thermoplastic material and said thermoplastic material.

34. A closure according to claim 33 wherein said thermoplastic material includes polypropylene as its major ingredient and wherein said compression moldable thermoplastic material has as its major ingredient a material selected from the group consisting of ethylene vinyl acetate copolymer, and styrene/rubber/polypropylene copolymer.

35. A closure according to claim 28 wherein said engaging means for engaging the finish portion of the container is a helical thread.

36. A package comprising, in combination:

a container having a finish portion, said finish portion including closure engaging means and terminating in a rim, and a closure sealingly engaging said finish portion of said container, said closure comprising;

a top portion spanning said finish of said container;

an annular skirt extending downwardly from said top portion and surrounding an upper portion of said finish portion of said container, including said rim, said annular skirt including engaging means securely engaging said closure engaging means of said finish portion of said container;

an annular member extending downwardly from said top portion of said closure, said annular member being separated form said annular skirt and forming a space therebetween; and sealing liner means positioned inside of said annular member, at least a portion of said sealing liner means lying against said finish portion of said container, said at least a portion of said sealing liner means being compressed between said top portion of said closure and at least said rim of said finish portion of said container to form a seal between said closure and said finish portion of said container, said sealing liner means being formed in situ within said closure against said top portion and against said annular member from a compression moldable thermoplastic material by compression molding.

37. A package according to claim 36 wherein said sealing liner means of said closure is imperforate in configuration.

38. A package according to claim 36 wherein said top portion, said annular skirt and said annular member of said closure are formed integrally with one another in one piece from a thermoplastic material.

39. A package according to claim 38 wherein said one piece is formed by a process that is selected from the group consisting of injection molding and compression molding.

40. A package according to claim 39 wherein said thermoplastic material has a major ingredient which is selected from the group consisting of high density polyethylene and polypropylene.

41. A package according to claim 38 wherein one of said annular member and said sealing liner means of said closure comprises radially extending recess means, wherein the other of said annular member and said sealing liner means of said closure comprises radially extending rib means, and wherein said radially extending rib means is received in said radially extending recess means to help to prevent relative rotation between said annular member and said sealing liner means of said closure.

42. A package according to claim 41 wherein said recess means comprises a plurality of circumferentially spaced apart, radially extending recesses, wherein said radially extending rib means comprises a plurality of circumferentially spaced apart radially extending ribs, each of said plurality of circumferentially spaced apart radially extending recesses receiving one of said plurality of circumferentially spaced apart radially extending ribs.

43. A package according to claim 42 wherein said compression moldable thermoplastic material is heat sealable to said thermoplastic material, and wherein said sealing liner means of said closure is formed in situ within said closure by compression molding at a temperature that is sufficiently high to form a heat seal bond between said compression moldable thermoplastic material and said thermoplastic material.

44. A package according to claim 43 wherein said thermoplastic material includes polypropylene as its major ingredient and wherein said compression moldable thermoplastic material has as its major ingredient a material selected from the group consisting of ethylene vinyl acetate copolymer, and styrene/rubber/polypropylene copolymer.

45. A package according to claim 38 wherein said closure engaging means of said container comprises a helical thread and wherein said engaging means of said closure comprises a helical thread.

46. A package according to claim 36 wherein said sealing liner means comprises a portion lying against said annular member in sealing engagement with at least a portion of said finish portion of said container, said annular member of said closure extending downwardly from said top of said closure sufficiently far to engage said portion of said sealing liner means and to maintain said portion of said sealing liner means firmly against said at least a portion of said finish portion of said container.

* * * * *